US006424083B1

(12) United States Patent
Tam et al.

(10) Patent No.: US 6,424,083 B1
(45) Date of Patent: Jul. 23, 2002

(54) FIELD EMISSION DEVICE HAVING AN IMPROVED BALLAST RESISTOR

(75) Inventors: Gordon Tam, Gilbert; Ganming Qin; Barry P. O'Brien, both of Chandler, all of AZ (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/501,071

(22) Filed: Feb. 9, 2000

(51) Int. Cl.[7] ..... H01J 1/30
(52) U.S. Cl. ..... 313/336; 313/351; 313/310
(58) Field of Search ..... 313/336, 351, 313/310

(56) References Cited

U.S. PATENT DOCUMENTS

| | | | | |
|---|---|---|---|---|
| 5,451,830 | A | 9/1995 | Huang | |
| 5,789,851 | A | 8/1998 | Turlot et al. | |
| 5,828,163 | A | 10/1998 | Jones et al. | |
| 5,886,460 | A | 3/1999 | Jones et al. | |
| 5,892,321 | A | 4/1999 | Itoh et al. | |
| 6,144,145 | A | * 11/2000 | Jones et al. | 313/311 |
| 6,169,357 | B1 | * 1/2001 | Potter | 313/495 |

FOREIGN PATENT DOCUMENTS

| | | |
|---|---|---|
| EP | 0316214 | 5/1989 |
| FR | 2764435 | 12/1998 |
| WO | 9723002 | 6/1997 |
| WO | 9831044 | 7/1998 |
| WO | 9904407 | 1/1999 |

* cited by examiner

*Primary Examiner*—Sandra O'Shea
*Assistant Examiner*—Ronald E. DelGizzi
(74) *Attorney, Agent, or Firm*—Kevin D. Wills; William E. Koch; Douglas W. Gilmore

(57) ABSTRACT

A field emission device (100) includes a cathode (110) and a ballast resistor (112) connected to cathode (110). Ballast resistor (112) includes a thin metallic layer (113) and a protective layer (114) disposed on metallic layer (113). Metallic layer (113) is made from chromium and has a thickness of about 40 angstroms. Protective layer (114) is made from sputtered silicon and has a thickness of about 500 angstroms. A portion of metallic layer (113) makes physical contact with cathode (110) and is sandwiched between cathode (110) and protective layer (114). Protective layer (114) is positioned to shield metallic layer (113) from high transient voltages.

23 Claims, 2 Drawing Sheets

FIELD EMISSION DEVICE HAVING AN IMPROVED BALLAST RESISTOR

FIELD OF THE INVENTION

The present invention pertains to the area of field emission devices and, more particularly, to ballast resistors for controlling current flow between the electron emitters and the cathode conductors of field emission devices.

BACKGROUND OF THE INVENTION

It is known in the art to provide a ballast resistor in the cathode plate of a field emission device. The ballast resistor is connected to the cathode metal, which is connected to the electron emitters. The resistance of the ballast resistor is higher than that of the cathode metal. The ballast resistor is useful for controlling current flow through the cathode conductor.

It is known in the art to employ sputtered silicon for the ballast resistor. However, this prior art ballast resistor suffers from several shortcomings. First, the resistivity of the sputtered silicon is very high. In order to provide the requisite resistance, the thickness of the ballast resistor is made relatively thick, on the order of $10^4$ angstroms. Because of the relatively thick ballast resistor, problems with step coverage can occur during subsequent deposition steps.

Secondly, the sputtered silicon has a temperature coefficient of resistance (TCR) that is relatively high. Thus, the ratio of normalized resistance over the typical specified operating temperature range (−40° C. to 80° C.) is typically within a range of 20–50. For example, ballast resistors made from sputtered silicon are known to have sheet resistances after vacuum bake within a range of $10^9$–$10^{12}$ ohms/square, which is much higher than desired. Such a large deviation in resistance can lead to deterioration of image quality at the extremes of the temperature range.

It is also known in the art to make the ballast resistor using plasma enhanced chemical vapor deposition (PECVD) of silicon, which is further doped with phosphorous or boron. The problem with PECVD silicon is its high TCR. A typical normalized resistance ratio for these prior art ballast resistors over the range of −40° C. to 80° C. is 30–100.

Furthermore, the resistance of the prior art ballast resistor can change appreciably during high-temperature process steps. For example, the sheet resistance of ballast resistors, which are made from PECVD silicon, can reach values within the range of 10 megaohm/square to 500 megaohm/square upon baking at temperatures within a range of 425–550° C.

Accordingly, there exists a need for a field emission device having an improved ballast resistor, which exhibits reduced deviation in resistance over the standard operating temperature range and lower resistance changes during high-temperature process steps, when contrasted with prior art ballast resistors.

Figure 1:
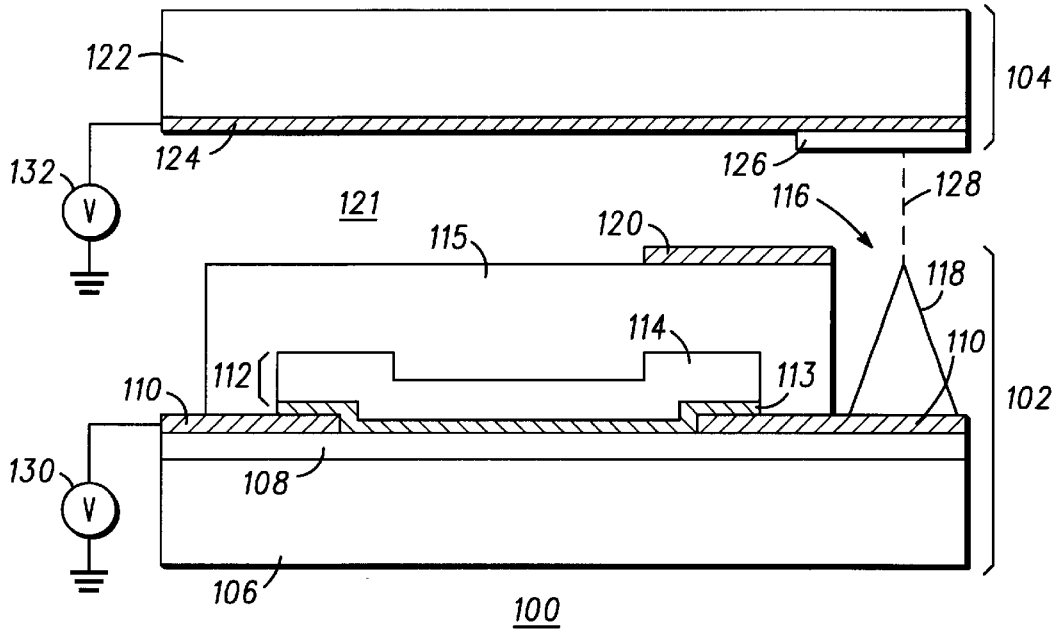
FIG. 1 is a cross-sectional partial view of a preferred embodiment of a field emission device, in accordance with the invention.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENT

The invention is for a field emission device having an improved bi-layer ballast resistor. A first layer of the ballast resistor is made from a metal, preferably a refractory metal. A second layer of the ballast resistor overlies the first layer and is preferably made from sputtered silicon. The second layer is useful for shielding and protecting the first layer. The preferred embodiment of the invention has a ballast resistor, which exhibits a ratio of normalized resistance that is within the range of 1.5 to 3 for an operating temperature range of −40° C. to 80° C.

The field emission devices described herein are directed to field emission displays employing Spindt tip emitter structures. However, the scope of the invention is not intended to be limited to display devices or to devices having Spindt tip emitter structures. Rather, the invention can be embodied by other types of field emission devices, such as microwave power amplifier tubes, ion sources, matrix-addressable sources of electrons for electron-lithography, and the like. Also, the invention can be embodied by a field emission device having one or more types of field emission emitter structures, such as Spindt tips, edge emitters, wedge emitters, surface conduction emitters, and the like. The invention can alternatively be embodied by an integrated circuit or discrete semiconductor device that requires a resistor with high resistance.

FIG. 1 is a cross-sectional partial view of a preferred embodiment of a field emission device (FED) 100, in accordance with the invention. FED 100 includes a cathode plate 102 and an anode plate 104. Cathode plate 102 includes a substrate 106, which can be made from glass, silicon, and the like. Preferably, substrate 106 is made from glass.

A first dielectric layer 108 is disposed upon substrate 106. First dielectric layer 108 is made from a dielectric material, such as an oxide, a nitride, and the like. Preferably, first dielectric layer 108 is made from silicon nitride and has a thickness equal to about 3000 angstroms. A cathode 110 is disposed upon first dielectric layer 108. Cathode 110 is made from a conductor, preferably molybdenum.

Also disposed upon first dielectric layer 108 is a ballast resistor 112. Ballast resistor 112 is connected to cathode 110 and is designed to be connected to a first voltage source 130. In the embodiment of FIG. 1, ballast resistor 112 extends between separated portions of cathode 110. One portion of cathode 110 is connected to an electron emitter 118, and the other portion is connected to first voltage source 130.

In accordance with the invention, ballast resistor 112 has a metallic layer 113 and a protective layer 114. Metallic layer 113 is disposed on first dielectric layer 108 and is physically connected to cathode 110. Protective layer 114 overlies metallic layer 113. At the location at which metallic layer 113 physically contacts cathode 110, a portion of metallic layer 113 is preferably sandwiched between cathode 110 and protective layer 114.

Metallic layer 113 is preferably made from a refractory metal, such as titanium, tantalum, tungsten, molybdenum, an alloy that includes one of these metals, and the like. Most preferably, metallic layer 113 includes chromium. Metallic layer 113 can be deposited using only a pure chromium source. Alternatively, metallic layer 113 can be deposited using a chromium-silicon alloy target. In the preferred embodiment, metallic layer 113 is a metal alloy, which contains primarily chromium and silicon, as well as some oxygen and nitrogen. The oxygen and nitrogen are believed to originate from adjacent layers and exposure to water vapor in the vacuum chamber. Further, metallic layer 113 preferably has a thickness within a range of 10–200 angstroms, most preferably about 40 angstroms.

Preferably, the materials and dimensions of metallic layer 113 and protective layer 114 are further selected to cause the sheet resistance of protective layer 114 to be at least two orders of magnitude greater than the sheet resistance of metallic layer 113.

In the preferred embodiment, protective layer 114 is made from silicon and has a thickness within a range of 500–2000 angstroms, most preferably 500 angstroms. Most preferably, protective layer 114 is a layer of sputtered silicon.

In the embodiment of FIG. 1, cathode plate 102 further includes a second dielectric layer 115, which is disposed on ballast resistor 112. The material of cathode 110 is distinct from the material of protective layer 114, and the material of protective layer 114 is distinct from the material of second dielectric layer 115. Preferably, second dielectric layer 115 is made from silicon nitride and has a thickness equal to about 7000 angstroms. Alternatively, dielectric layer 115 can be made from silicon dioxide or a combination of silicon nitride and silicon dioxide layers. Second dielectric layer 115 further defines an emitter well 116 in which electron emitter 118 is disposed. A gate electrode 120 is formed on second dielectric layer 115 and is connected to a second voltage source (not shown).

Application of selected potentials to cathode 110 and gate electrode 120 can cause electron emitter 118 to emit an electron beam 128. Protective layer 114 modifies the electric field at metallic layer 113 in a manner that improves the breakdown characteristics of ballast resistor 112 when high transient voltages are applied.

Anode plate 104 is disposed to receive electron beam 128. In the preferred embodiment of FIG. 1, anode plate 104 is spaced apart from cathode plate 102 to define an interspace region 121. Anode plate 104 includes a transparent substrate 122 made from a solid, transparent material, such as a glass. An anode 124 is disposed on transparent substrate 122 and is preferably made from a transparent, conductive material, such as indium tin oxide. Anode 124 is connected to a third voltage source 132.

A phosphor 126 is disposed upon anode 124, thereby defining a display device. Phosphor 126 is cathodoluminescent and emits light upon activation by electron beam 128. Methods for fabricating anode plates for matrix-addressable FED's are known to one of ordinary skill in the art. During the operation of FED 100, a potential is applied to anode 124 for attracting electron beam 128 toward phosphor 126.

Figure 2:
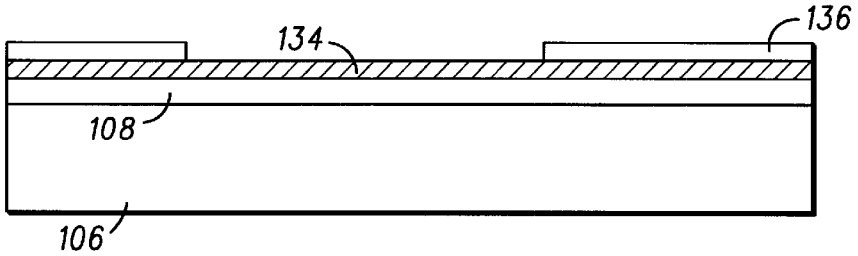
FIGS. 2–4 are cross-sectional views of structures realized during the fabrication of the preferred embodiment of FIG. 1.
Figure 3:
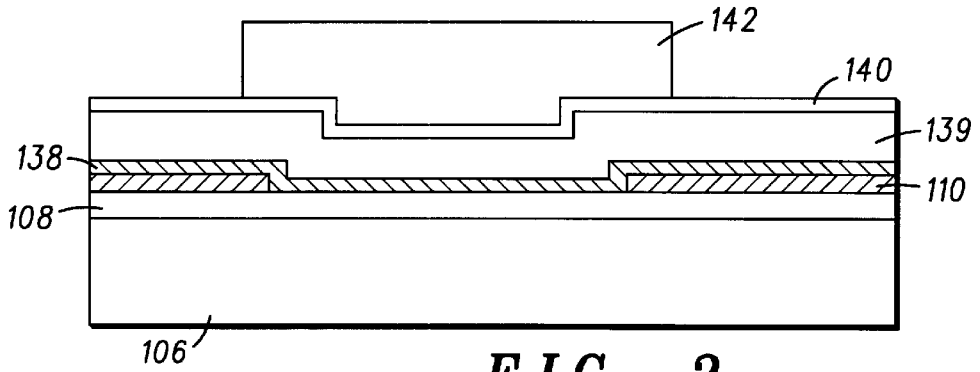
Figure 4:
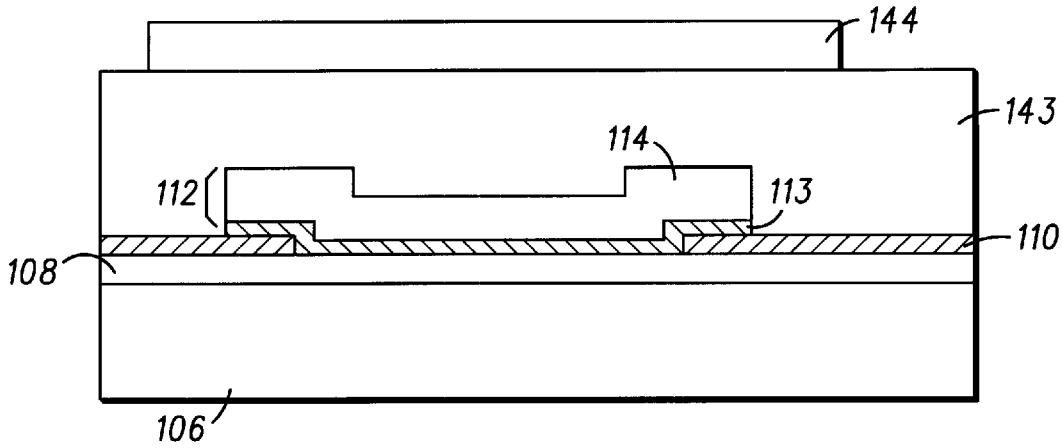

FIGS. 2–4 are cross-sectional views of structures realized during the fabrication of the preferred embodiment of FIG. 1. Silicon nitride is deposited on substrate 106 by using a convenient deposition technique, such as plasma-enhanced chemical vapor deposition (PECVD), thereby forming first dielectric layer 108. Thereafter, a layer 134 of the cathode conductor material is deposited on first dielectric layer 108 to a thickness of about 3000 angstroms. Thereafter, a mask layer 136, which can be a photoresist, is deposited on layer 134. Mask layer 136 defines the pattern to be etched into layer 134. Then, layer 134 is selectively etched, thereby forming cathode 110.

Thereafter, as illustrated in FIG. 3, a first layer 138 of metal is deposited on cathode 110 and first dielectric layer 108. Preferably, first layer 138 is formed by the sputtering of chromium at low power, within a range of about 120–180 watts, and at an argon partial pressure of 0.42 Pascal. It has been observed that a lower chromium sputtering power results in a higher sheet resistance of ballast resistor 112 and a higher resistance ratio (R(25° C.)/R(80° C.)) for ballast resistor 112.

After the formation. of first layer 138, a second layer 139 of silicon is sputtered onto first layer 138. During the transition from the deposition of first layer 138 to the deposition of second layer 139, the vacuum is not broken. First layer 138 defines an interfacial layer, which lies between first dielectric layer 108 and second layer 139, and contains the selected metal, as well as silicon, oxygen and nitrogen.

After the formation of second layer 139, a passivation layer 140 is formed on second layer 139. Passivation layer 140 is useful for protecting the underlying layers during subsequent processing steps. Preferably, passivation layer 140 is made by depositing silicon nitride using a convenient deposition method, such as PECVD, to a thickness of about 1000 angstroms. Thereafter, a mask layer 142, which can be a photoresist, is deposited to define the pattern of the ballast resistor.

Passivation layer 140, second layer 139, and first layer 138 are selectively etched, thereby realizing ballast resistor 112, as illustrated in FIG. 4. Thereafter, a layer 143 of silicon nitride is deposited by PECVD to a thickness of 6000 angstroms. Layer 143 is patterned and etched using a mask layer 144 to realize second dielectric layer 115 (FIG. 1).

After the elements of cathode plate 102 (FIG. 1) have been deposited, cathode plate 102 is baked in a vacuum at a temperature of about 425° C. It has been observed that ballast resistor 112 has a post-bake sheet resistance within a range of about $1.5\times10^4$ to about $9\times10^6$ ohms/square when the chromium deposition power is within a range of 120–180 watts. Furthermore, the temperature coefficient of resistance at 25° C. was observed to be equal to about 3000 ppm/°C. The ratio of normalized resistance was determined to be within a range of 1.5 to 3 for an operating temperature range of −40° C. to 80° C. These values are within one to two orders of magnitude less than those of prior art ballast resistors. Furthermore, the per cent change in sheet resistance due to the baking step was observed to be equal to about 5%, which is also an improvement over prior art ballast resistors.

Figure 5:
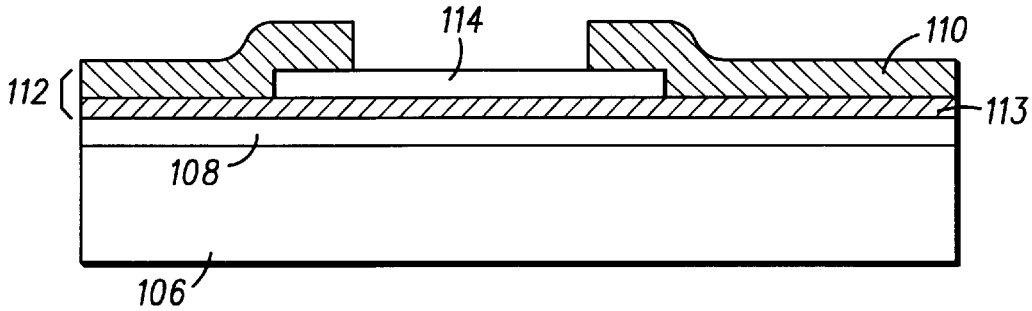
FIG. 5 is a cross-sectional view of a structure realized during the fabrication of another embodiment of a field emission device, in accordance with the invention.

FIG. 5 is a cross-sectional view of a structure realized during the fabrication of another embodiment of a field emission device, in accordance with the invention. In the embodiment represented by FIG. 5, cathode 110 is deposited on ballast resistor 112, rather than beneath it. Furthermore, metallic layer 113 extends beyond protective layer 114 to make physical contact with cathode 110.

In summary, the invention is for a field emission device having an improved ballast resistor for controlling current at the electron emitters. The ballast resistor of the invention includes a thin metallic layer, which is shielded by a protective layer. The resistance of the ballast resistor of the invention is high enough to achieve the desired current control. Additionally, the ballast resistor of the invention exhibits a lower TCR than prior art ballast resistors.

While we have shown and described specific embodiments of the present invention, further modifications and improvements will occur to those skilled in the art. For example, the ballast resistor of the invention can include one or more layers in addition to the metallic layer and the sputtered silicon layer. The invention is embodied, for example, by a FED having a second protective layer, which is made from a material distinct from that of the sputtered silicon layer and which is deposited on the sputtered silicon layer. Further modification of the electric field may be achieved by such a configuration. We desire it to be understood, therefore, that this invention is not limited to the particular forms shown, and we intend in the appended claims to cover all modifications that do not depart from the spirit and scope of this invention.

We claim:

1. A field emission device comprising:

an electron emitter;

a cathode made from a first material and connected to the electron emitter;

a metallic layer physically connected to the cathode;

a protective layer overlying the metallic layer and made from a second material; and a dielectric layer overlying the protective layer and made from a third material, wherein the first material of the cathode is distinct from the second material of the protective layer, and the second material of the protective layer is distinct from the third material of the dielectric layer.

2. The field emission device as claimed in claim 1, wherein the metallic layer comprises a refractory metal.

3. The field emission device as claimed in claim 2, wherein the metallic layer comprises chromium.

4. The field emission device as claimed in claim 3, wherein the metallic layer further comprises silicon.

5. The field emission device as claimed in claim 1, wherein the metallic layer has a thickness within a range of 10–200 angstroms.

6. The field emission device as claimed in claim 5, wherein the metallic layer has a thickness equal to about 40 angstroms.

7. The field emission device as claimed in claim 1, wherein the metallic layer is characterized by a first sheet resistance, wherein the protective layer is characterized by a second sheet resistance, and wherein the second sheet resistance of the protective layer is at least two orders of magnitude greater than the first sheet resistance of the metallic layer.

8. The field emission device as claimed in claim 1, wherein the second material of the protective layer comprises silicon.

9. The field emission device as claimed in claim 8, wherein the second material of the protective layer comprises sputtered silicon.

10. The field emission device as claimed in claim 1, wherein the third material of the dielectric layer comprises silicon nitride.

11. The field emission device as claimed in claim 1, wherein the protective layer has a thickness within a range of 500–2000 angstroms.

12. The field emission device as claimed in claim 1, further comprising:

a transparent substrate;

an anode disposed on the transparent substrate; and a phosphor connected to the anode and disposed to receive an electron beam from the electron emitter.

13. The field emission device as claimed in claim 1, wherein a portion of the metallic layer is sandwiched between the cathode and the protective layer.

14. A field emission device comprising:

an electron emitter;

a cathode connected to the electron emitter;

a metallic layer physically connected to the cathode; and a protective layer overlying the metallic layer, wherein said protective layer comprises sputtered silicon.

15. The field emission device as claimed in claim 14, wherein the metallic layer comprises a refractory metal.

16. The field emission device as claimed in claim 15, wherein the metallic layer comprises chromium.

17. The field emission device as claimed in claim 16, wherein the metallic layer further comprises silicon.

18. The field emission device as claimed in claim 14, wherein the metallic layer has a thickness within a range of 10–200 angstroms.

19. The field emission device as claimed in claim 18, wherein the metallic layer has a thickness equal to about 40 angstroms.

20. The field emission device as claimed in claim 14, wherein the metallic layer is characterized by a first sheet resistance, wherein the protective layer is characterized by a second sheet resistance, and wherein the second sheet resistance of the protective layer is at least two orders of magnitude greater than the first sheet resistance of the metallic layer.

21. The field emission device as claimed in claim 14, wherein the protective layer has a thickness within a range of 500–2000 angstroms.

22. The field emission device as claimed in claim 14, wherein a portion of the metallic layer is sandwiched between the cathode and the protective layer.

23. The field emission device as claimed in claim 14, further comprising:

a transparent substrate;

an anode disposed on the transparent substrate; and a phosphor connected to the anode and disposed to receive an electron beam from the electron emitter.

* * * * *